US012258760B1

(12) United States Patent
Albidah et al.

(10) Patent No.: US 12,258,760 B1
(45) Date of Patent: Mar. 25, 2025

(54) LINKAGE FOR INCREASING THE DUCTILITY OF FIBER REINFORCED POLYMER BARS

(71) Applicant: KING SAUD UNIVERSITY, Riyadh (SA)

(72) Inventors: Abdulrahman Sulaiman Albidah, Riyadh (SA); Mohamed Jamal Alshannag, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 123 days.

(21) Appl. No.: 18/379,830

(22) Filed: Oct. 13, 2023

(51) Int. Cl.
*E04C 3/00* (2006.01)
*E04C 5/07* (2006.01)
*E04C 5/16* (2006.01)

(52) U.S. Cl.
CPC ..... *E04C 5/165* (2013.01); *E04C 5/07* (2013.01)

(58) Field of Classification Search
CPC ..... E04C 5/165; E04C 5/07
See application file for complete search history.

(56) References Cited

U.S. PATENT DOCUMENTS 368,764 A * 8/1887 Hammer ..... F16G 11/04 403/314
2,934,935 A * 5/1960 Zerna ..... E04C 5/12 52/223.13
4,373,309 A * 2/1983 Lutz ..... E04F 11/035 411/389
5,193,932 A * 3/1993 Wu ..... E04C 5/165 403/309
5,770,286 A * 6/1998 Sorkin ..... E04C 5/12 52/223.13
5,813,185 A * 9/1998 Jackson ..... E04G 17/0657 52/405.1
7,878,730 B2 2/2011 Weaver
(Continued)

FOREIGN PATENT DOCUMENTS

CN 203977714 U 12/2014
CN 107313557 A 11/2017
(Continued)

OTHER PUBLICATIONS

Koushfar, Kiarash, et al. "Bond behavior of the reinforcement bar in glass fiber-reinforced polymer connector." Građevinar 66.04. (2014): 301-310.

*Primary Examiner* — Basil S Katcheves
(74) *Attorney, Agent, or Firm* — Nath, Goldberg & Meyer; Joshua B. Goldberg

(57) ABSTRACT

The linkage for increasing the ductility of fiber reinforced polymer bars includes a solid central shaft and first and second hollow receiver portions. Each of the first and second hollow receiver portions has an open end and a closed end, with the closed ends being respectively secured to first and second ends of the solid central shaft. Each of the first and second hollow receiver portions has a diameter associated therewith which is greater than a diameter of the solid central shaft, and each of the first and second hollow receiver portions has a central channel extending axially from, and in communication with, the corresponding one of the open ends. In use, the central channels of the first and second hollow receiver portions are adapted for respectively partially receiving first and second fiber reinforced polymer bars.

23 Claims, 4 Drawing Sheets

(56) References Cited

U.S. PATENT DOCUMENTS

| | | | | |
|---|---|---|---|---|
| 10,125,802 | B2 * | 11/2018 | Lin | E21D 21/008 |
| 10,731,345 | B1 * | 8/2020 | Wilson | F16G 11/048 |
| 10,995,494 | B2 * | 5/2021 | Sorkin | E04C 5/10 |
| 2002/0110413 | A1 * | 8/2002 | Gregel | E04G 21/122 403/305 |
| 2002/0157333 | A1 * | 10/2002 | Kadotani | E04C 5/165 52/223.13 |
| 2004/0156672 | A1 * | 8/2004 | Thomas | E04C 5/127 403/266 |
| 2010/0003074 | A1 * | 1/2010 | Kim | E04C 5/165 403/334 |
| 2011/0081545 | A1 * | 4/2011 | Rovira Soler | E04C 5/07 428/365 |
| 2015/0300022 | A1 * | 10/2015 | Wang | E04C 5/165 29/256 |
| 2015/0368902 | A1 * | 12/2015 | Roers | B28B 11/042 52/745.19 |
| 2016/0138268 | A1 * | 5/2016 | Pierce | E04C 5/20 52/742.16 |
| 2016/0258160 | A1 * | 9/2016 | Radhouane | E04C 5/0613 |
| 2016/0305140 | A1 * | 10/2016 | Wilson | E04C 5/165 |
| 2018/0187418 | A1 * | 7/2018 | Prowse | E04B 1/215 |
| 2020/0071932 | A1 * | 3/2020 | Park | F16B 7/04 |
| 2022/0235550 | A1 * | 7/2022 | Yoon | E04C 5/165 |

FOREIGN PATENT DOCUMENTS

| | | | |
|---|---|---|---|
| CN | 206693510 | U | 12/2017 |
| DE | 7425730 | U | 2/1975 |
| EP | 2000605 | A2 | 12/2008 |
| KR | 102537821 | B1 | 5/2023 |

* cited by examiner

LINKAGE FOR INCREASING THE DUCTILITY OF FIBER REINFORCED POLYMER BARS

BACKGROUND

Field

The disclosure of the present patent application relates to structural elements, and particularly to a linkage for increasing the ductility of fiber reinforced polymer (FRP) bars for reinforced concrete and the like.

Description of Related Art

Fiber reinforced polymer (FRP) is a composite made of a polymer matrix and fibers such as carbon, glass, aramid and basalt fibers. FRP materials are used in concrete structures in the form of laminates, rods and sheets. The partial replacement of steel bars with FRP bars is common in the external surfaces of reinforced concrete structures that are exposed to aggressive environments. It has been found that strengthening reinforced concrete structures using FRP bars provides high tensile strength and stiffness, a high strength/weight ratio, and excellent durability. Recently, there has been a growing interest in building structures with FRP composites and repairing damaged structural members subject to harsh conditions, corrosion and earthquakes. FRP composites possess many desirable structural properties, including a high tensile strength, non-corrosiveness, high stiffness, light weight, high durability and low thermal transmission, thus making FRP generally superior over traditional structural materials, such as reinforcing steel bars, steel plates, wire meshes, and textiles.

Despite the widespread use of FRP in the construction industry, some issues related to their performance are still of concern. The lack of ductility of FRP bars is a primary concern. The "ductility" of a material is its ability to undergo large plastic deformations prior to failure. The ductility of reinforced concrete structures is important to ensure considerable deformations under sustained loading while maintaining adequate load carrying capacity. This provides sufficient warning before failure, thus enhancing the safety of the structure and potentially saving lives. Given the importance of ductility, enhancing the ductility of reinforced concrete structures is of tremendous interest in the fields of construction and structural engineering. Thus, a linkage for increasing the ductility of fiber reinforced polymer bars solving the aforementioned problems is desired.

SUMMARY

The linkage for increasing the ductility of fiber reinforced polymer bars includes a solid central shaft and first and second hollow receiver portions. Each of the first and second hollow receiver portions has an open end and a closed end, with the closed end of the first hollow receiver portion secured to a first end of the solid central shaft, and the closed end of the second hollow receiver portion secured to a second end of the solid central shaft. Each of the first and second hollow receiver portions has an outer diameter associated therewith which is greater than an outer diameter of the solid central shaft, and each of the first and second hollow receiver portions has a central channel extending axially from, and in communication with, the corresponding one of the open ends.

Each of the solid central shaft, the first hollow receiver portion and the second hollow receiver portion may be cylindrical, and may further be axially aligned such that the open ends of the first and second hollow receiver portions are opposed with respect to one another. A first transition portion may be located between the closed end of the first hollow receiver portion and the first end of the solid central shaft. Similarly, a second transition portion may be located between the closed end of the second hollow receiver portion and the second end of the solid central shaft. Each of the first and second transition portions may be substantially frustoconical in shape. In use, the central channels of the first and second hollow receiver portions are adapted for respectively partially receiving first and second fiber reinforced polymer bars. At least the solid central shaft has a ductility associated therewith which is greater than a ductility of the first and second fiber reinforced polymer bars. As a non-limiting example, at least the solid central shaft may be made of steel.

Additionally, the outer diameter of the solid central shaft may be greater than a nominal diameter associated with the first and second fiber reinforced polymer bars. Each of the central channels of the first and second hollow receiver portions may have a threaded surface for releasably engaging the first and second fiber reinforced polymer bars. A strong adhesive, such as epoxy, may also be used to secure the first and second fiber reinforced polymer bars within their corresponding central channels.

The material forming the linkage for increasing the ductility of fiber reinforced polymer bars has a ductility greater than that of the fiber reinforced polymer (FRP) bars, thus allowing the linkage to replace what is ordinarily the highly stressed part of an FRP bar under tension. The tensile failure force of the linkage is about 90% of the rupture force of the FRP bar. Additionally, the linkage may be coated with any suitable type of anticorrosive agent or the like. As a further alternative, the first hollow receiver portion and the second hollow receiver portion may have textured or deformed outer surfaces for enhancing their bond strengths with concrete.

These and other features of the present subject matter will become readily apparent upon further review of the following specification.

BRIEF DESCRIPTION OF DRAWINGS

Similar reference characters denote corresponding features consistently throughout the attached drawings.

DETAILED DESCRIPTION

Figure 1:
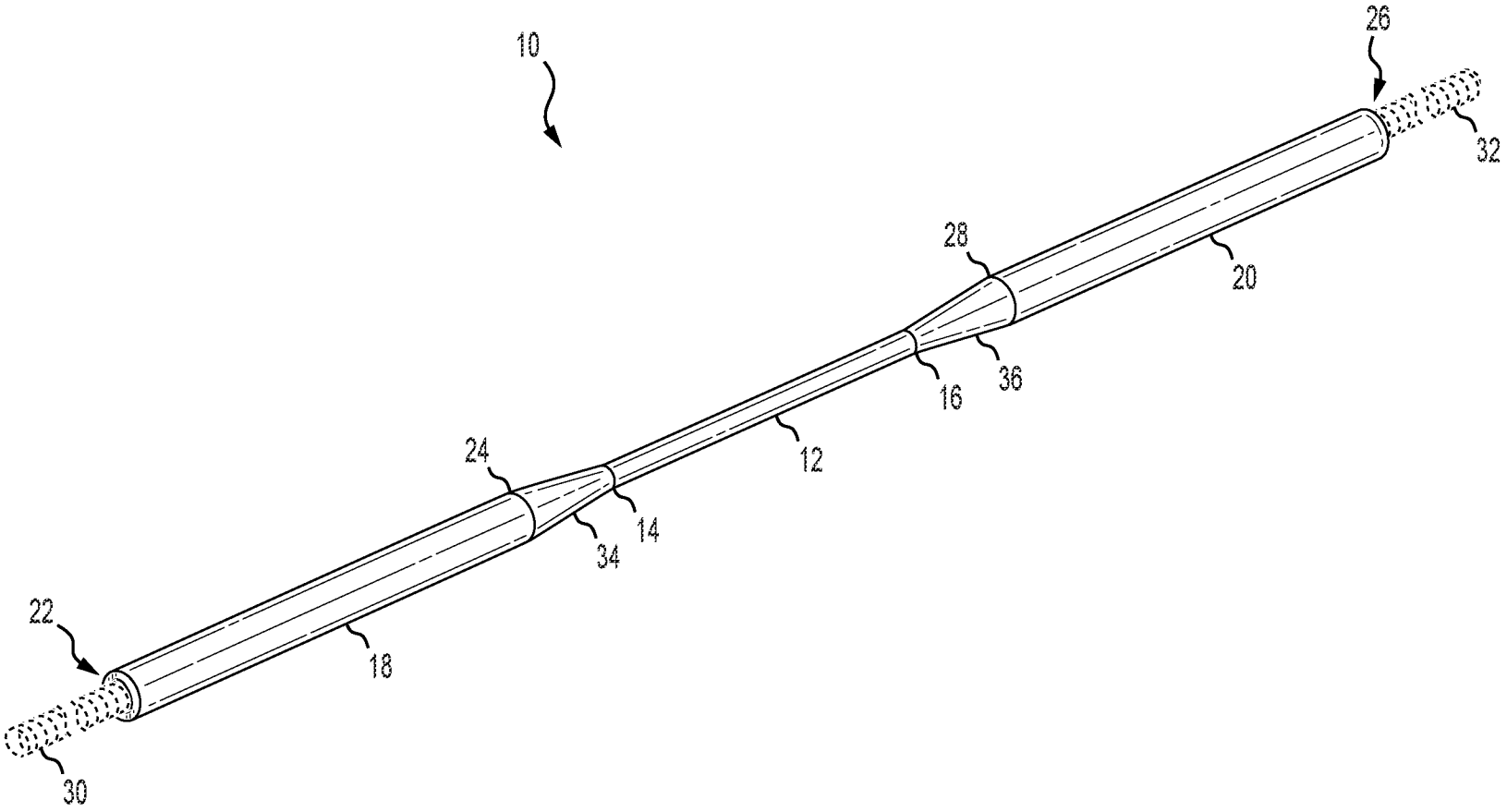
FIG. 1 is an environmental perspective view of a linkage for increasing the ductility of fiber reinforced polymer bars.
Figure 2:
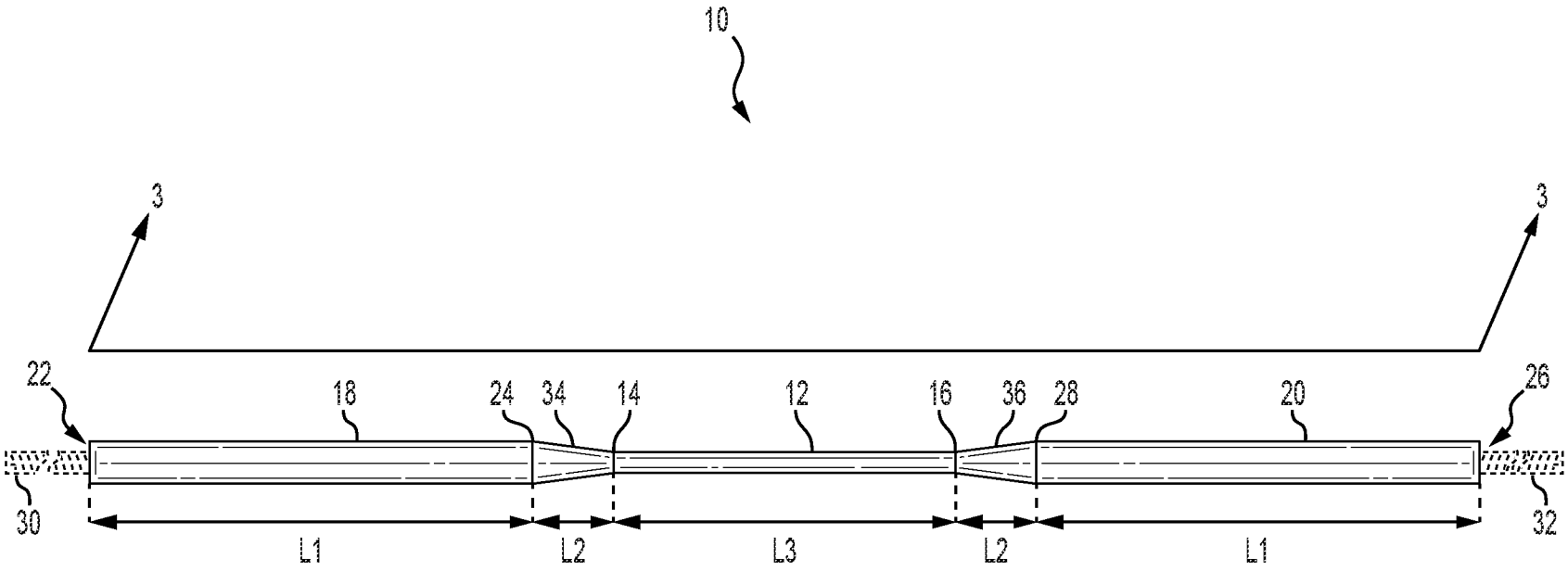
FIG. 2 is a side view of the linkage for increasing the ductility of fiber reinforced polymer bars.
Figure 3:
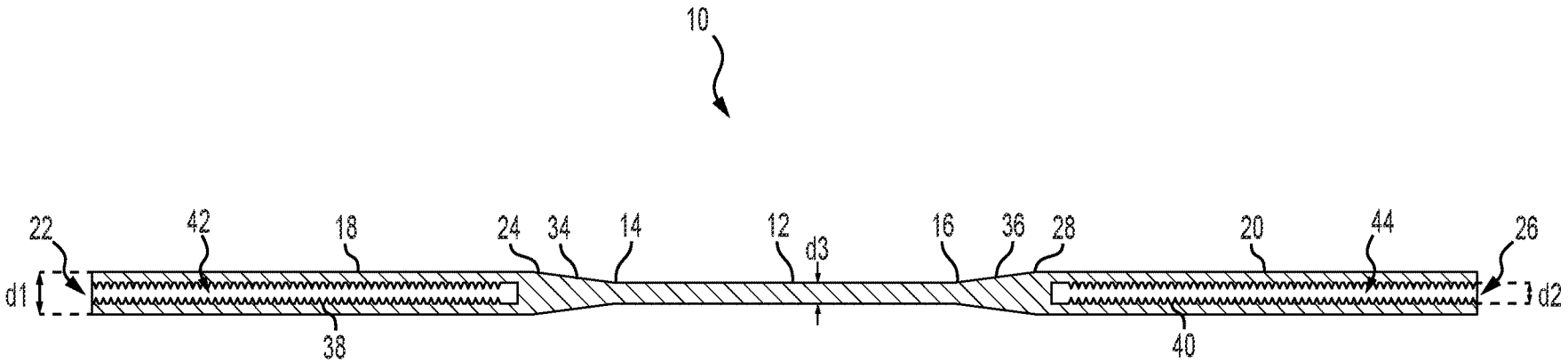
FIG. 3 is a cross-sectional view of the linkage for increasing the ductility of fiber reinforced polymer bars, taken along cut lines 3-3 of FIG. 2.

As shown in FIGS. 1-3, the linkage for increasing the ductility of fiber reinforced polymer bars 10 includes a solid central shaft 12 and first and second hollow receiver portions 18, 20, respectively. The first hollow receiver portion 18 has opposed open and closed ends 22, 24, respectively, and, similarly, the second hollow receiver portion 20 has opposed open and closed ends 26, 28, respectively. The closed end 24 of the first hollow receiver portion 18 is secured to a first end 14 of the solid central shaft 12 and, similarly, the closed end 28 of the second hollow receiver portion 20 is secured to a second end 16 of the solid central shaft 12. As indicated in FIG. 3, each of the first and second hollow receiver portions 18, 20 has an outer diameter d1 associated therewith which is greater than an outer diameter d3 of the solid central shaft 12, and each of the first and second hollow receiver portions 18, 20 has a central channel 42, 44, respectively, extending axially from, and in communication with, the corresponding one of the open ends 22, 26.

Each of the solid central shaft 12, the first hollow receiver portion 18 and the second hollow receiver portion 20 may be cylindrical, as shown, and may further be axially aligned such that the open ends 22, 26 of the first and second hollow receiver portions 18, 20, respectively, are opposed with respect to one another. A first transition portion 34 may be located between the closed end 24 of the first hollow receiver portion 18 and the first end 14 of the solid central shaft 12. Similarly, a second transition portion 36 may be located between the closed end 28 of the second hollow receiver portion 20 and the second end 16 of the solid central shaft 12. Each of the first and second transition portions 34, 36 may be substantially frustoconical in shape, as shown.

In use, the central channels 42, 44 of the first and second hollow receiver portions 18, 20, respectively, are adapted for respectively partially receiving first and second fiber reinforced polymer bars 30, 32. Each of the central channels 42, 44 of the first and second hollow receiver portions 18, 20, respectively, may have a threaded surface 38, 40, respectively, for releasably engaging the first and second fiber reinforced polymer bars 30, 32. A strong adhesive, such as epoxy, may also be used to secure the first and second fiber reinforced polymer bars 30, 32 within their corresponding central channels.

It should be understood that at least the solid central shaft 12 of the linkage for increasing the ductility of fiber reinforced polymer bars 10 may be made from any suitable material having a ductility which is greater than that associated with the first and second fiber reinforced polymer bars 30, 32. As a non-limiting example, at least the solid central shaft 12 may be made from steel. The greater ductility of the steel allows the linkage 10 to replace what is ordinarily the highly stressed part of an FRP bar under tension. The tensile failure force of linkage 10 is about 80-90% of the rupture force of the FRP bar. Additionally, linkage 10 may be coated with any suitable type of anticorrosive agent or the like. As a further alternative, the first hollow receiver portion and the second hollow receiver portion 18, 20 may have textured or deformed outer surfaces for enhancing their bond strengths with concrete. It is contemplated that all elements of the linkage are made of the same material, for instance, all elements are made from steel.

The outer diameter d3 of the solid central shaft 12 may be selected such that tensile force in the solid central shaft 12 does not exceed 80%-90% of the tensile force in the fiber reinforced polymer (FRP) bars 30, 32 in order to avoid any uncertainty associated with material strength. Thus, as an example, the outer diameter d3 may be selected to meet the following criterion:

$$\frac{\pi}{4}(d3)^2 f_{su} < \frac{\pi}{4}(d_f)^2 f_{fr},$$

where $f_{su}$ is the ultimate strength of the solid central shaft 12, $d_f$ is the nominal diameter of each of the FRP bars 30, 32, and $f_{fr}$ is the ultimate strength of each of the FRP bars 30, 32.

The diameter d2 of each of the central channels 42, 44 may be selected to be larger than the nominal diameter $d_f$ of each of the FRP bars 30, 32 to allow for a gap sufficient for receiving enough epoxy to bond the FRP bars 30, 32 within their respective central channels. The bonding between each of the central channels 42, 44 and the FRP bars 30, 32 can also be made mechanically by manufacturing FRP bars, 30,32 with threaded ends. The outer diameter d1 of the first and second hollow receiver portions 18, 20 may be selected to ensure that the first and second hollow receiver portions 18, 20 do not yield when the FRP bars 30, 32 reach their ultimate tensile strength at maximum load for the entire linkage. Thus, the following criterion may be used for selecting the outer diameter d1 of the first and second hollow receiver portions 18, 20:

$$\frac{\pi}{4}(d_f)^2 f_{fr} < \frac{\pi}{4}\left[(d1)^2 - (d2)^2\right] f_{sy},$$

where $f_{sy}$ is the yielding strength of the first and second hollow receiver portions 18,20.

With reference to FIG. 2, the length of each of the first and second hollow receiver portions 18, 20 L1 may be selected to ensure that the full tensile strength of the FRP bars 30, 32 can develop without experiencing pull off failure between the FRP bars 30, 32 and the surrounding epoxy/steel, such that $$\frac{\pi}{4}(d_f)^2 f_{fr} \le \pi d_f \tau L1 \Rightarrow L1 = \frac{d_f f_{fr}}{4\tau},$$

where $\tau$ is the minimum bond strength between a) epoxy and steel; and b) epoxy and the FRP bar.

In experiment, a linkage for increasing the ductility of fiber reinforced polymer bars 10 was constructed from mild steel and used with glass fiber reinforced polymer (GFRP) bars. A displacement control uniaxial tension machine with a 100 kN capacity was used for testing. The GFRP bars had nominal diameters $d_f$ of 9.84 mm, with an ultimate strength $f_{fr}$ of 850-900 MPa and a rupture strain of 1.6%, giving a maximum axial force of 64.6-68.4 kN. The outer diameter d3 of the solid central shaft 12 was selected to be larger than the nominal diameter of the GFRP bars, with a diameter of 12 mm, such that the achieved tensile force of the steel became close to, but less than, the GFRP bar tensile strength; i.e., $$\frac{\pi}{4}(d3)^2 f_{su} < \frac{\pi}{4}(d_f)^2 f_{fr},$$

as discussed above.

The length L2 of the transition portions 34, 36 was selected to be as small as possible for the purpose of providing a smooth transition from the first and second hollow receiver portions 18, 20 to smaller solid central shaft 12. The L3 of the solid central shaft 12 was 200 mm in the experiments, which provided good ductility overall, with the plastic deformation being much higher than the elastic deformation, thus not requiring any increases to the length. Additionally, in the experiments, the length L1 of each of the first and second hollow receiver portions 18, 20 was 250 mm, and the length L2 of the transition portions 34, 36 was 50 mm. The outer diameter d1 of each of the first and second hollow receiver portions 18, 20 was 25 mm, the diameter d2 of each of the central channels 22, 26 was 16 mm, and the diameter d3 of the solid central shaft 12 was 12 mm. The yielding strength $f_{sy}$ of the steel was 379 MPa, and the ultimate strength of the steel $f_{su}$ was 538 MPa. The epoxy used in the experiments was Sikadur® Hex-300, manufactured by Sika®.

Figure 4:
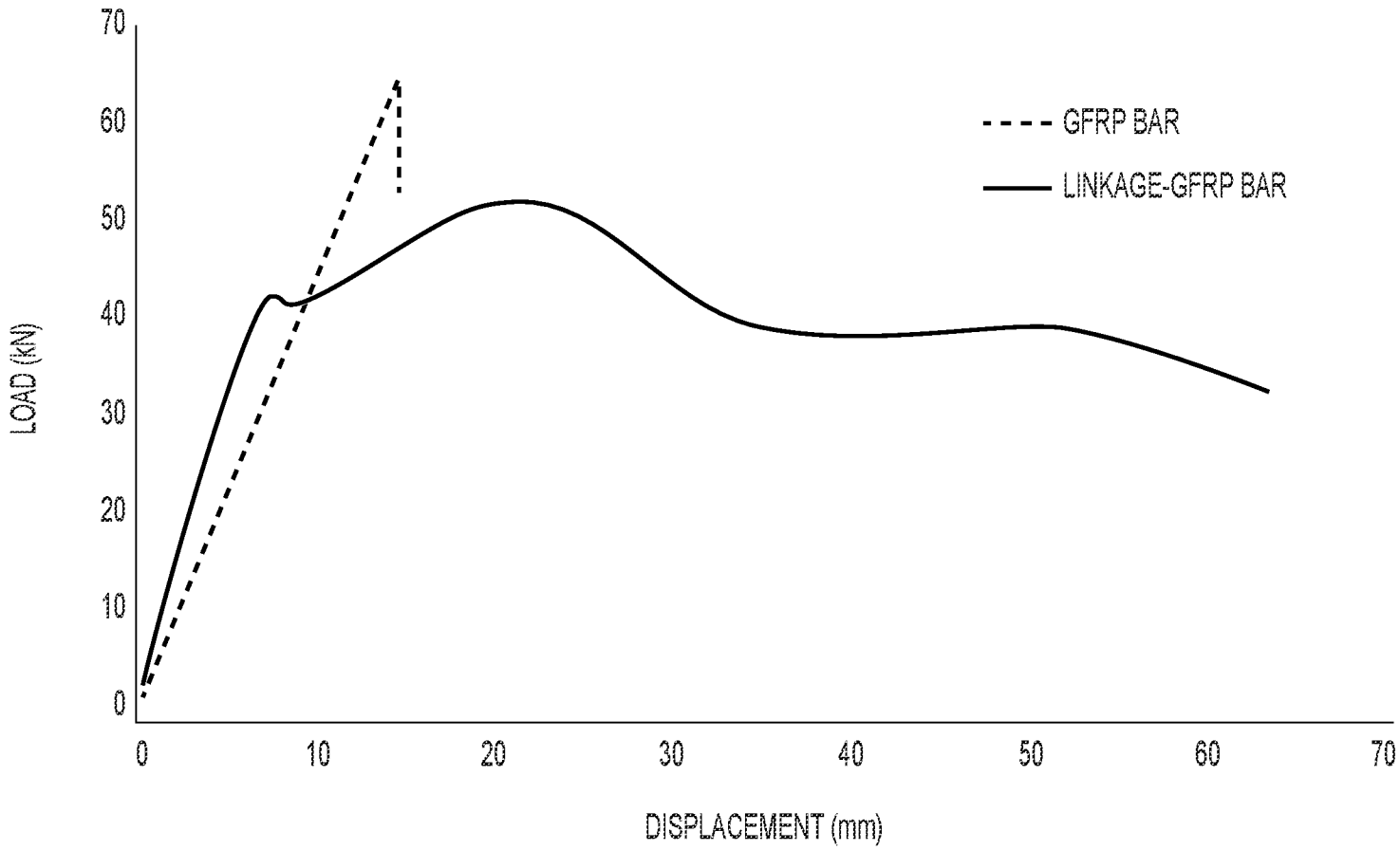
FIG. 4 is a graph comparing the load-displacement relationship of the linkage for increasing the ductility of fiber reinforced polymer bars, linked with a glass fiber reinforced polymer (GFRP) bar, against a GFRP bar alone.

A direct uniaxial tension test was performed on the linkage for increasing the ductility of fiber reinforced polymer bars 10 with the geometrical and material properties described above. One end of the linkage 10 was attached to a GFRP bar and the other end was gripped directly to the jaw of the direct uniaxial tension testing machine. The experimental load-displacement relationship for the tested linkage 10 and the GFRP bar is shown in FIG. 4. For comparison purposes, the load-displacement relationship for a GFRP bar of a total length of 900 mm (equivalent to the tested linkage and GFRP bar combination) is shown on the same graph.

The load-displacement relationship of the linkage-GFRP bar combination shown in FIG. 4 demonstrates a substantial increase in ductility, specifically about four times larger in the displacement when compared to the load-displacement relationship of the GFRP bar alone. Furthermore, the load-displacement relationship of the linkage-GFRP bar combination is almost identical to a typical tensile stress-strain response for a mild steel bar. This level of enhancement in the ductile response was achieved while reaching a maximum tensile force of 51.8 kN, which represents 80% of the rupture strength of the GFRP bar alone. This percentage can be further improved to 90% or 95% of the ultimate strength of the GFRP bar by increasing the diameter of the solid central shaft 12. The final failure mode of the linkage-GFRP bar combination was characterized by a typical necking (i.e., cup-cone) ductile failure within the upper end of the middle third of the specimen (i.e., when arranged vertically in the testing machine, the upper end of the solid central shaft 12). The large plastic deformation achieved at solid central shaft is very useful for enhancing the ductile performance of flexural controlled members (e.g., beams) if the center of the ductile link is made to coincide with the center of the anticipated plastic hinge region (i.e., the region of maximum bending moment).

It is to be understood that the linkage for increasing the ductility of fiber reinforced polymer bars is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

The invention claimed is:

1. A linkage for increasing the ductility of fiber reinforced polymer bars, comprising:

a solid central shaft having opposed first and second ends; and first and second hollow receiver portions each having an open end and a closed end, the closed end of the first hollow receiver portion being secured to the first end of the solid central shaft, and the closed end of the second hollow receiver portion being secured to the second end of the solid central shaft, wherein each of the first and second hollow receiver portions has an outer diameter associated therewith which is greater than an outer diameter of the solid central shaft, and wherein each of the first and second hollow receiver portions has a central channel extending from, and in communication with, a corresponding one of the open ends, wherein the central channels of the first and second hollow receiver portions are adapted for respectively receiving first and second fiber reinforced polymer bars at least partially therein, wherein the solid central shaft has a ductility associated therewith which is greater than a ductility of the first and second fiber reinforced polymer bars, and wherein an ultimate tensile strength of the solid central shaft is smaller than an ultimate tensile strength of the first and second fiber reinforced polymer bars.

2. The linkage for increasing the ductility of fiber reinforced polymer bars as recited in claim 1, wherein each of the solid central shaft, the first hollow receiver portion and the second hollow receiver portion is cylindrical.

3. The linkage for increasing the ductility of fiber reinforced polymer bars as recited in claim 2, wherein the solid central shaft, the first hollow receiver portion and the second hollow receiver portion are axially aligned.

4. The linkage for increasing the ductility of fiber reinforced polymer bars as recited in claim 3, further comprising:

a first transition portion located between the closed end of the first hollow receiver portion and the first end of the solid central shaft; and a second transition portion located between the closed end of the second hollow receiver portion and the second end of the solid central shaft.

5. The linkage for increasing the ductility of fiber reinforced polymer bars as recited in claim 4, wherein each of the first and second transition portions is frustoconical.

6. The linkage for increasing the ductility of fiber reinforced polymer bars as recited in claim 1, wherein each of the central channels of the first and second hollow receiver portions has a threaded surface.

7. The linkage for increasing the ductility of fiber reinforced polymer bars as recited in claim 1, wherein each of the central channels extends axially with respect to the corresponding one of the first and second hollow receiver portions.

8. The linkage for increasing the ductility of fiber reinforced polymer bars as recited in claim 1, wherein the outer diameter of the solid central shaft is greater than a nominal diameter associated with the first and second fiber reinforced polymer bars.

9. The linkage for increasing the ductility of structural members as recited in claim 1, wherein the linkage is positioned within the maximum moment region of the structural member.

10. The linkage for increasing the ductility of structural members as recited in claim 1, wherein the ultimate tensile strength of the solid central shaft ranges from about 80% to about 90% of the ultimate tensile strength of the first and second fiber reinforced polymer bars.

11. The linkage for increasing the ductility of structural members as recited in claim 1, wherein the ultimate tensile strength of the solid central shaft is 95% of the ultimate tensile strength of the first and second fiber reinforced polymer bars.

12. Fiber reinforced polymer bars with a linkage for increasing the ductility thereof, comprising:

first and second fiber reinforced polymer bars; and a linkage comprising:

a solid central shaft having opposed first and second ends; and first and second hollow receiver portions each having an open end and a closed end, the closed end of the first hollow receiver portion being secured to the first end of the solid central shaft, and the closed end of the second hollow receiver portion being secured to the second end of the solid central shaft, wherein each of the first and second hollow receiver portions has an outer diameter associated therewith which is greater than an outer diameter of the solid central shaft, and wherein each of the first and second hollow receiver portions has a central channel extending from, and in communication with, a corresponding one of the open ends, wherein the central channels of the first and second hollow receiver portions, respectively, are configured to receive therein at least partially the first and second fiber reinforced polymer bars, wherein the solid central shaft has a ductility associated therewith which is greater than a ductility of the first and second fiber reinforced polymer bars, and wherein an ultimate tensile strength of the solid central shaft is smaller than an ultimate tensile strength of the first and second fiber reinforced polymer bars.

13. The fiber reinforced polymer bars with a linkage for increasing the ductility thereof as recited in claim 12, wherein each of the solid central shaft, the first hollow receiver portion and the second hollow receiver portion is cylindrical.

14. The fiber reinforced polymer bars with a linkage for increasing the ductility thereof as recited in claim 13, wherein the solid central shaft, the first hollow receiver portion and the second hollow receiver portion are axially aligned.

15. The fiber reinforced polymer bars with a linkage for increasing the ductility thereof as recited in claim 14, further comprising:

a first transition portion located between the closed end of the first hollow receiver portion and the first end of the solid central shaft; and a second transition portion located between the closed end of the second hollow receiver portion and the second end of the solid central shaft.

16. The fiber reinforced polymer bars with a linkage for increasing the ductility thereof as recited in claim 15, wherein each of the first and second transition portions is frustoconical.

17. The fiber reinforced polymer bars with a linkage for increasing the ductility thereof as recited in claim 12, wherein each of the central channels of the first and second hollow receiver portions has a threaded surface.

18. The fiber reinforced polymer bars with a linkage for increasing the ductility thereof as recited in claim 12, wherein each of the central channels extends axially with respect to the corresponding one of the first and second hollow receiver portions.

19. The fiber reinforced polymer bars with a linkage for increasing the ductility thereof as recited in claim 12, wherein the outer diameter of the solid central shaft is greater than a nominal diameter of the first and second fiber reinforced polymer bars.

20. The fiber reinforced polymer bars with a linkage for increasing the ductility thereof as recited in claim 12, wherein the first and second fiber reinforced polymer bars are secured within the central channels of the first and second hollow receiver portions by an adhesive.

21. The fiber reinforced polymer bars with a linkage for increasing the ductility thereof as recited in claim 20, wherein the adhesive comprises an epoxy adhesive.

22. The fiber reinforced polymer bars with a linkage for increasing the ductility thereof as recited in claim 12, wherein the ultimate tensile strength of the solid central shaft ranges from about 80% to about 90% of the ultimate tensile strength of the first and second fiber reinforced polymer bars.

23. The fiber reinforced polymer bars with a linkage for increasing the ductility thereof as recited in claim 12, wherein the ultimate tensile strength of the solid central shaft is 95% of the ultimate tensile strength of the first and second fiber reinforced polymer bars.

* * * * *